United States Patent [19]

Matsumoto et al.

[11] Patent Number: 4,616,943

[45] Date of Patent: Oct. 14, 1986

[54] APPARATUS FOR PREVENTING THE RISE OF AN INK RIBBON

[75] Inventors: Yoshikane Matsumoto; Toshio Hiki, both of Ibaraki, Japan

[73] Assignee: Hitachi Koki Company, Limited, Tokyo, Japan

[21] Appl. No.: 587,786

[22] Filed: Mar. 9, 1984

[30] Foreign Application Priority Data

Mar. 11, 1983 [JP] Japan ..... 58-41149
Nov. 5, 1983 [JP] Japan ..... 58-208077

[51] Int. Cl.[4] ..... B41J 35/26

[52] U.S. Cl. ..... 400/247; 400/248; 101/93.05; 101/336

[58] Field of Search ..... 400/247, 248, 248.1, 400/248.2, 248.3; 101/93.04, 93.05, 93.14, 336

[56] References Cited

U.S. PATENT DOCUMENTS 3,874,285 4/1975 Kodaira et al. ..... 400/248 X
4,033,255 7/1977 Kleist et al. ..... 101/93.04
4,285,604 8/1981 Rex ..... 400/247
4,311,401 1/1982 Hiki et al. ..... 101/336 X
4,325,645 4/1982 Miyajima et al. ..... 400/248 X
4,387,642 6/1983 Bringhurst et al. ..... 101/93.04
4,437,401 3/1984 Heinrich et al. ..... 101/336 X

FOREIGN PATENT DOCUMENTS 0064143 11/1982 European Pat. Off. ..... 400/248
0024183 3/1981 Japan ..... 400/247

OTHER PUBLICATIONS

IBM Technical Disclosure Bulletin, "Ribbon Retainer", Bonafino et al, vol. 19, No. 2, Jul. 1976, p. 439.

*Primary Examiner*—Ernest T. Wright, Jr.
*Attorney, Agent, or Firm*—Sughrue, Mion, Zinn, Macpeak & Seas

[57] ABSTRACT

An auxiliary ribbon separator for use on a dot-line printer is positioned to prevent vertical ribbon displacement in the presence of upward forces such as caused by perforations on continuous feed paper. The auxiliary separator is located so that the ribbon is guided past an end of a front yoke. The front yoke serves as a course ribbon guide and is a component of the electro-magnetic assembly of the print head associated with the printer. The auxiliary separator may be shaped so as to facilitate loading of the ribbon in the printer.

10 Claims, 10 Drawing Figures

APPARATUS FOR PREVENTING THE RISE OF AN INK RIBBON

BACKGROUND OF THE INVENTION

1. Field of the Invention:

This invention relates to an apparatus for preventing the vertical displacement or "rise" of an ink ribbon in a dot-line printer.

2. Description of the Prior Art:

Many types of printers are available and are used as output units for computers. Of these types, the use of a dot-line printer recently has shown a rapid increase in popularity. This type of printer has several desirable features including a high degree of font flexibility and a high printing speed. Prior art dot-line printers, however, are prone to ribbon rise.

The pertinent structure of a prior art dot-line printer and the problem of rise of an ink ribbon will hereinafter be discussed with reference to FIGS. 1 to 3.

The dot-line printer is a type of printer having printing hammers 11 designed for the dot printing of letters of figures each composed of a dot matrix. A hammer unit 10 carries a plurality of printing hammers 11 which are spaced laterially apart from one another along the direction of the line to be printed and are reciprocally movable. Each printing hammer 11 comprises a leaf spring formed with a printing pin 12 positioned at one end thereof. This leaf spring is disposed in an electromagnetic sub-assembly which comprises a permanent magnet 13, a generally L-shaped yoke plate 14, a comb yoke 16 provided with a release solenoid coil 15, and a front yoke 17.

The comb yoke 16 is secured to the yoke plate 14 by bolts, not shown. The front yoke 17, the printing hammers 11 and the permanent magnet 13 are secured to the yoke plate 14 by a bolt 18. The printing hammer 11 normally is held in a bent form against one end of the comb yoke 16 by the attractive force of the permanent magnet 13. The solenoid coil 15 is energizable to enable printing. If the solenoid coil 15 is energized, the attractive force of the permanent magnet 13 is overcome, and the printing hammer 11 is released from the comb yoke 16, so that the printing pins 12 may strike ink ribbon 20 and paper 30 against a platen 50. The ink with which the ink ribbon 20 is impregnated is transferred onto the paper 30 to effect dot printing. The hammer unit 10 is supported movably in the direction of the line to be printed by a shafft 62 provided with a slide bearing 19 at each end thereof, and secured to a mechanical frame 60 by bolts 61. The hammer unit 10 is reciprocally movable in the direction of the line to be printed by a drive system, not shown. The distance of such reciprocal movement is at least equal to the distance between two adjoining printing hammers 11. The paper 30 is drawn through the printer from below upward by a tractor, not shown, for each printed dot line. The reciprocal motion of the hammer unit 10, the feeding of the paper 30 and the driving of the printing hammers 11 are selectively controlled as to enable the printing of the desired letters and figures each composed of a dot matrix. The ink ribbon 20 is in the form of a tape as shown by the two-dot chain lines in FIG. 2, and travels in front of the front yoke 17 generally in the direction of the printed line. More specifically, the ink ribbon 20 travels at an angle to the printing pins 12 which are aligned together in the hammer unit 10, as shown in FIG. 2. This allows the ribbon 20 to be used more efficiently resulting in prolonged ribbon life. The hammer unit 10 carries a main ribbon separator 21 disposed between the ink ribbon 20 and the paper 30. The main ribbon separator 21 comprises a thin stainless steel plate, and is provided to deter the rise of the ink ribbon 20 when the paper 30 is fed upward. The main ribbon separator 21 also serves to prevent any contamination of the paper 30 by the ink ribbon 20.

The main ribbon separator 21 has apertures 26 through which printing pins 12 pass to effect printing. A duct is provided above the hammer unit 10 for cooling the solenoid coil 15. A hammer unit cover 70 is connected to the frame 60 by a stand 63. A paper press holder 71 is provided above the hammer cover 70 for stabilizing travel of the paper 30. The hammer unit cover 70 has a side facing the platen 50 and located close to the front yoke 17, as shown in FIG. 1. The ink ribbon 20 can easily be set in position without having its lower edge interferring with the adjacent end of the front yoke 17. The ink ribbon 20 travels between two spools, not shown. Ribbon travel may be reversed alternately to travel from the left to the right and from the right to the left in a manner well known in the art.

In the dot-line printer hereinabove described, the problem of ink ribbon rise is not completely eliminated by ribbon separator 21. The rise of the ink ribbon 20 means it moves vertically relative to its desired position displacing it from the position in which it faces the printing pins 12 on the printing hammer 11. This results in printing omissions which is unacceptable. One of the primary reasons for this trouble is the presence of perforations 31 formed in continuous feed-type paper 30 for dividing one page from another. Typically, perforations 31 project toward the hammer unit 10 as shown in FIG. 1; however, they may also project in the opposite direction. When the perforated portion of the paper 30 passes between the platen 50 and the printing pins 12, the ink ribbon 20 is compressed between the ribbon separator 21 and the front yoke 17. This creates a very large resistance to the ink ribbon 20 travel in front of the hammer unit 10. This resistance increases with an increase in the thickness and type of the paper 30. Under ordinary circumstances, the ink ribbon 20 usually has an adequate degree of tension to insure that it travels along the desired path while it is travelling. The presence of perforations 31 of the paper 30 between the platen 50 and the printing pins 12, however, creates a larger resistance than such ribbon tension, especially if the paper 30 is thick. This resistance causes the ink ribbon 20 to vary in the direction of its travel. This destroys the stability in the travel of the ink ribbon 20. The ink ribbon 20 travel sometimes is caused to move up and down, and its lower edge is caught by the corner 17' of the front yoke 17 as shown at circled portion A in FIG. 2. If the ink ribbon 20 is traveling from the left to the right in FIG. 2, it progressively enters the clearance between the upper end of the front yoke 17 and the hammer cover 70, and moves away from the printing pins 12 on the printing hammers 11, as shown by two-dot chain line in FIG. 3. This results in total printing omissions. This trouble can be avoided if the front yoke 17 is enlarged so that its corner 17' may extend to a higher position. This method is, however, undesirable for a number of reasons, including difficulty in the manufacture of the front yoke 17, an increase in the mass of the hammer unit 10 and interference with hammer unit cover 70.

Another problem has already been pointed out. Although the clearance between the upper end of the front yoke 17 and the hammer cover 70 is very small, the ink ribbon 20 only has a thickness of 1 to 2 mm. Consequently, the ink ribbon 20 can readily enter the space between the front yoke 17 and the hammer unit cover 70. The ink ribbon 20 is, therefore, difficult to set properly in position.

SUMMARY OF THE INVENTION

It is an object of this invention to eliminate the drawbacks of the prior art as hereinabove pointed out, and prevent the rise of an ink ribbon in a dot-line printer, while simultaneously making it easy to set the ink ribbon in position.

This invention is based on the discovery that the trouble in question is due to the clearance between the hammer cover and the front yoke, and consists essentially in the partial elimination of this clearance without hindering the travel of the ink ribbon and the printing paper.

DESCRIPTION OF THE PREFERRED EMBODIMENTS

Figure 1:
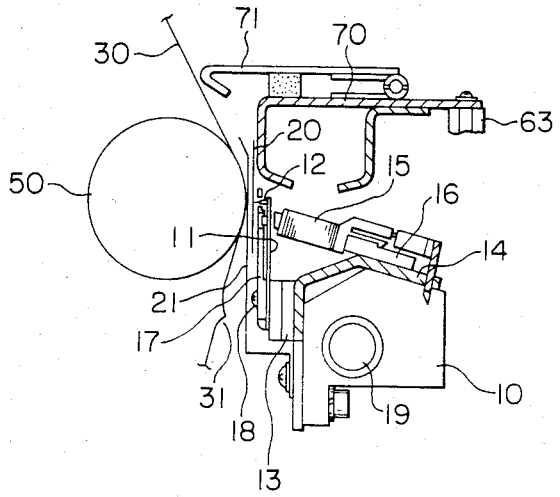
FIG. 1 PRIOR ART
FIG. 1 is a sectional view of a hammer unit and its location in a dot-line printer according to the prior art.
Figure 2:
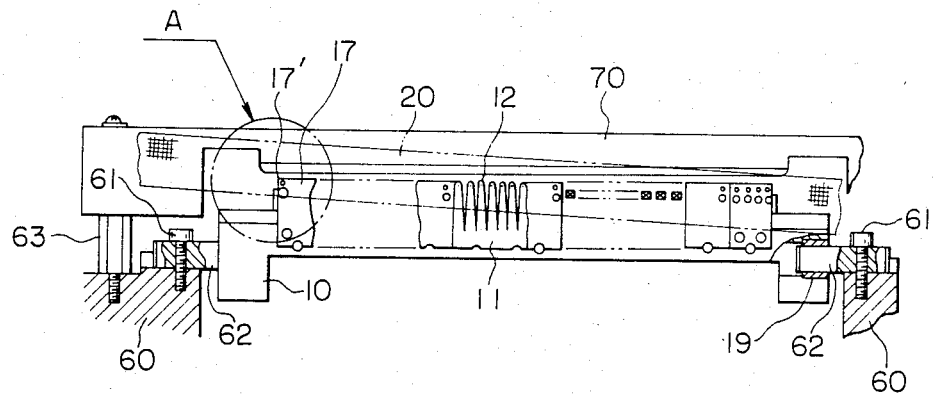
FIG. 2 PRIOR ART
FIG. 2 is a front elevational view of the hammer unit of FIG. 1 as viewed from the platen side, but not showing a ribbon separator.
Figure 3:
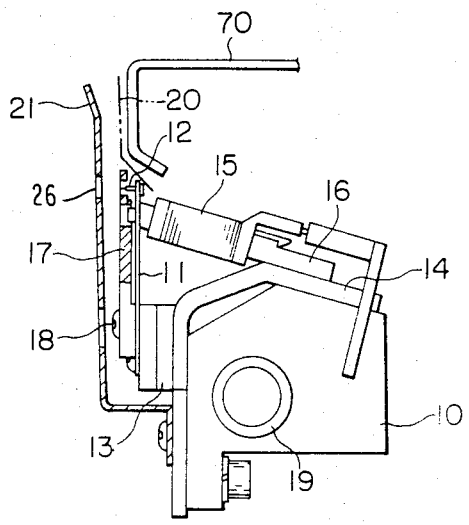
FIG. 3 PRIOR ART
FIG. 3 is a sectional view of part A of FIG. 2.
Figure 4:
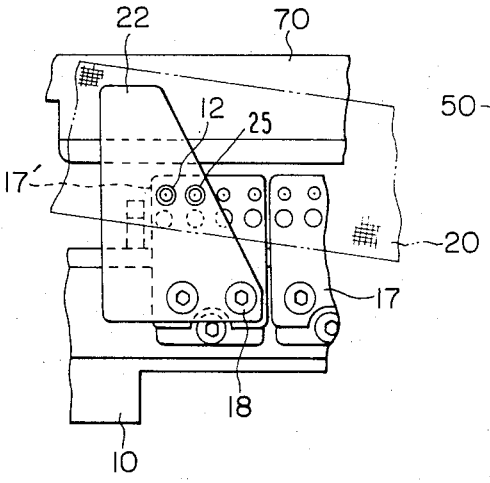
FIG. 4 is a fragmentary front elevational view of a hammer unit according to a first embodiment of the present invention, including an auxiliary ribbon separator.
Figure 5:
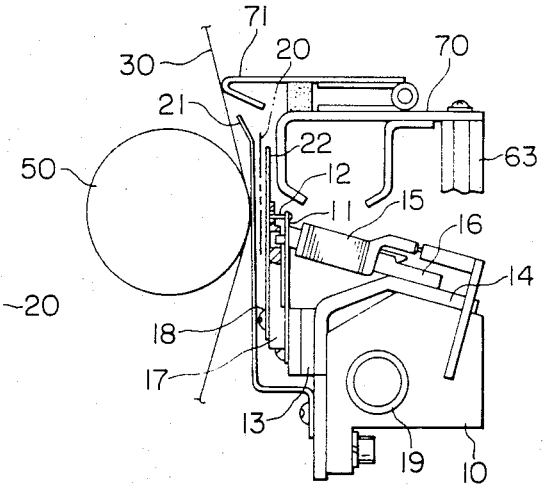
FIG. 5 is a sectional view of the apparatus shown in FIG. 4.

An apparatus according to a first embodiment of the present invention is shown in FIGS. 4 and 5. The construction of a hammer unit 10 per se and its position in a conventional dot-line printer with which the apparatus of this invention is associated are not features of the present invention. The hammer unit 10 and its location in a dot printer was described above in connection with the prior art, and will not be described again, except for certain aspects which will hereinafter be described.

As shown in FIG. 4, the apparatus of this invention comprises an auxiliary ribbon separator 22 attached to the front yoke 17 on its side facing the ink ribbon 20, and covering its corner 17'. The separator 22 is made of a thin stainless steel plate. The separator 22 has a plurality of holes 25 facing the printing pins 12 to enable printing. The separator 22 extends beyond the upper end of the front yoke 17 and covers that side of the hammer cover 70 which faces the platen 50. The separator 22 is secured to the front yoke 17 by the bolts 18. The ink ribbon 20 travels through the clearance between the main ribbon separator 21 and the auxiliary ribbon separator 22. The auxiliary ribbon separator 22 and the hammer cover 70 are appropriately spaced apart from each other to avoid undue wear. The auxiliary ribbon separator 22 has only a small area of contact with that side of the front yoke 17 which faces the platen 50. Therefore, it hardly adds any resistance to the feed of the paper 30 or the travel of the ink ribbon 20.

The auxiliary ribbon separator 22 is considerably smaller than the main ribbon separator 21. If it is made as large as the main ribbon separator 21 so as to cover the front yoke 17, it is unacceptable from a practical standpoint, since it easily gets warped or distorted. In addition, if separator 21 is made large, it will narrow the clearance between the front yoke 17 and the platen 50 through which the paper 30 passes, resulting in increased resistance to the passage of the paper 30 and the travel of the ink ribbon 20. Although in the apparatus hereinabove described, the auxiliary ribbon separator 22 is intimately adjacent to the front yoke 17, it may be modified as will hereinafter be described.

Figure 6:
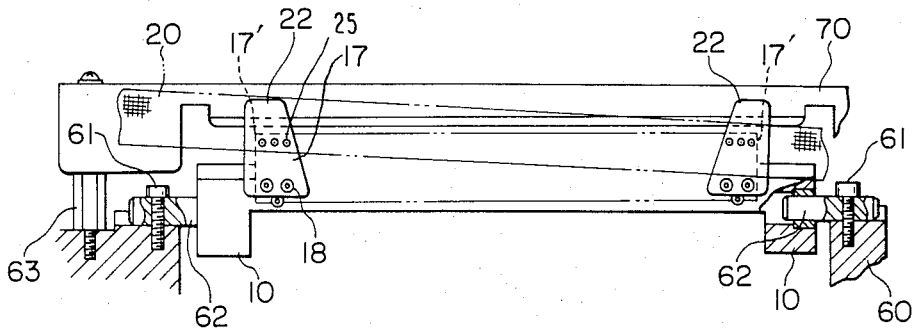
FIG. 6 is a view of the hammer unit as viewed from the platen side in the apparatus shown in FIG. 5.

As can be seen from the platen side of the printer illustrated in FIG. 6, the auxiliary ribbon separator 22 is provided in contact with the front yoke 17 at each end of the hammer unit 10. It prevents the ink ribbon 20 from contacting the corner 17' of the front yoke 17 at each end of the hammer unit 10. In other words, it prevents the lower edge of the ink ribbon 20 from being caught by the upper end of the front yoke 17 in the event the ink ribbon 20 is vertically displaced for some reason or other. In FIG. 5, the relationship of the paper press holder 71 to auxiliary separator 22 is shown in its closed position. The holder is movable to its open position for loading the ink ribbon and maintenances purposes.

Figure 7:
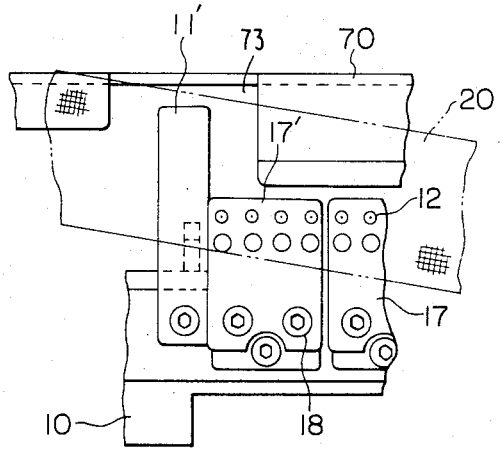
FIG. 7 is a fragmentary front elevational view of a hammer unit showing a second embodiment of the present invention.
Figure 8:
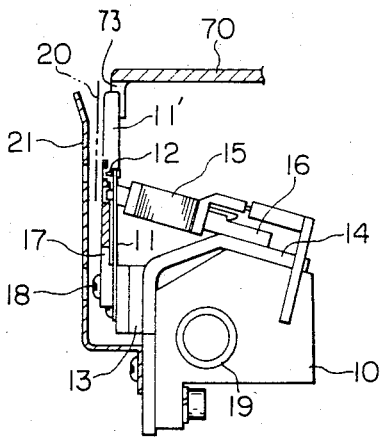
FIG. 8 is a sectional view of the apparatus shown in FIG. 7.

The electro-magnetic circuit for the printing hammer 11 at each end of the hammer unit 10 differs from the magnetic circuit for any other printing hammer 11, since no printing hammer is provided at either end of the hammer unit 10. In this connection, it is usual to provide a dummy hammer 11' at each end of the hammer unit 10 as shown in FIGS. 7 and 8 wherein a second embodiment of the invention is illustrated. The dummy hammer 11' has an upward extension covering the corner 17' of the front yoke 17, and thereby provides the function of the auxiliary ribbon separator 22 hereinbefore described. The hammer unit cover 70 is partly recessed at 73 so that it will not interfere with the dummy hammer 11'.

Although the auxiliary ribbon separator 22 as hereinabove described enables a substantial reduction in the frequency of rise of the ink ribbon 20, it can make it more difficult to load the ink ribbon 20. When the paper press holder 71 is opened and the ink ribbon 20 is placed between the main ribbon separator 21 and the auxiliary ribbon separator 22, it is likely that the ink ribbon 20 inadvertently may be placed between the auxiliary ribbon separator 22 and the hammer cover 70. This possibility can be minimized if the hammer unit cover 70 is almost in contact with the auxiliary ribbon separator 22. However, if separator 22 becomes warped or deformed and spaced apart from the hammer unit 70, it still would be possible to load the ink ribbon 20 incorrectly. Moreover, the contact of the separator 22 with the reciprocally moving hammer cover 70 would cause unnecessary wear on both components.

Figure 9:
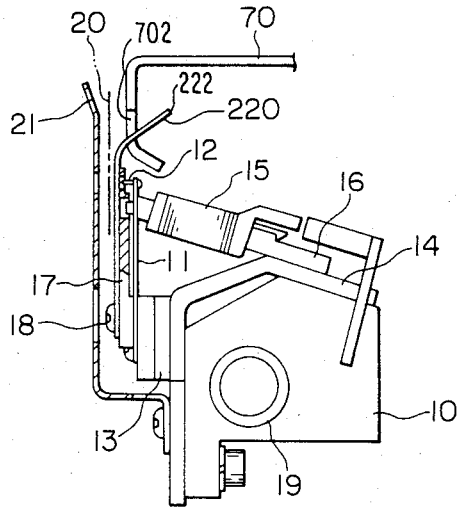
FIG. 9 is a sectional view of a hammer unit and its vicinity showing a third embodiment of the present invention.
Figure 10:
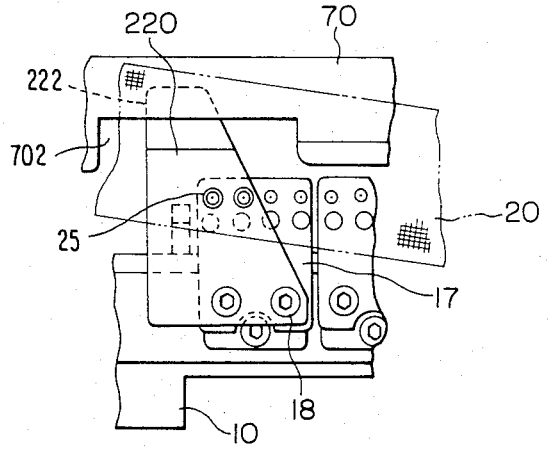
FIG. 10 is an enlarged view showing an auxiliary ribbon separator as viewed from the platen side in the apparatus shown in FIG. 9.

A third embodiment shown in FIGS. 9 and 10, of this invention, is proposed to ensure easy positioning of the ink ribbon and prevent any contact and resulting wear of the auxiliary ribbon separator and the hammer unit cover. This embodiment comprises an auxiliary ribbon separator 220 having an inwardly curved upper end 222 projecting into a recess 702 formed in a portion of the hammer unit cover 70. This arrangement eliminates any clearance between the separator 220 and the hammer cover unit 70 and thereby any erroneous positioning of the ink ribbon 20. The hammer unit cover 70 is partly recessed so that the separator 220 moving reciprocally with the hammer unit 10 will not interfere with the hammer unit cover 70.

What is claimed is:

1. In an apparatus for preventing the rise of an ink ribbon in a dot-line printer including a reciprocably driven hammer unit carrying a plurality of dot printing hammers spaced laterally apart from each other along the direction of a line to be printed, said ink ribbon being in the form of a tape and positioned to travel in said direction in front of said hammer unit, and a main ribbon separator disposed between said ribbon and a paper to be printed, the improvement comprising a front yoke in the form of a plate defining a front portion of said hammer unit for guiding the travel of said ink ribbon past said printing hammers, and an auxiliary ribbon separator in the form of a plate attached to at least one end of said front yoke wherein said auxiliary ribbon separator extends beyond a corner of an upper end of said front yoke and covers the corner of said front yoke at its upper end to prevent said ribbon from contacting said corner and being caught thereon in the event that said ribbon is vertically displaced.

2. The apparatus of claim 1, wherein an upper end of said auxiliary ribbon separator is bent inwardly and is positioned to project into a hammer unit cover.

3. The apparatus of claim 1 wherein said printing hammers include printing pins and said auxiliary ribbon separator has one or more apertures through which at least the printing pins of said printing hammers may pass to enable printing on said paper in the area of said auxiliary ribbon separator.

4. The apparatus of claim 1 wherein said auxiliary ribbon separator comprises an upward extension of a dummy hammer positioned at an end of said hammer unit.

5. The apparatus of claim 2 wherein said hammer unit cover is recessed to receive said upper end of said auxiliary ribbon separator.

6. The apparatus of claim 1 wherein said auxiliary ribbon separator is secured to said front yoke by one or more fastening devices.

7. The apparatus of claim 1 wherein said auxiliary ribbon separator is positioned so as to have only a small area of contact with said front yoke.

8. The apparatus of claim 1 wherein said auxiliary ribbon separator comprises a thin stainless steel plate.

9. The apparatus of claim 1 wherein said auxiliary ribbon separator is positioned so that said ribbon travels between said main ribbon separator and said auxiliary ribbon separator.

10. The apparatus of claim 1 wherein said dot-line printer further includes a hammer unit cover and wherein said auxiliary ribbon separator is positioned so that said auxiliary ribbon separator is not in contact with said hammer unit cover.

* * * * *